US009645531B2

(12) United States Patent
Kurokawa

(10) Patent No.: US 9,645,531 B2
(45) Date of Patent: May 9, 2017

(54) IMAGE FORMING APPARATUS

(71) Applicant: KYOCERA Document Solutions Inc., Osaka (JP)

(72) Inventor: Ayaka Kurokawa, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 15/192,018

(22) Filed: Jun. 24, 2016

(65) Prior Publication Data

US 2016/0378026 A1 Dec. 29, 2016

(30) Foreign Application Priority Data

Jun. 29, 2015 (JP) ..... 2015-130190

(51) Int. Cl.

*G03G 15/16* (2006.01)
*G03G 15/01* (2006.01)
*G03G 15/00* (2006.01)

(52) U.S. Cl.

CPC ..... *G03G 15/1665* (2013.01); *G03G 15/0136* (2013.01); *G03G 15/1605* (2013.01); *G03G 15/55* (2013.01); *G03G 15/1675* (2013.01)

(58) Field of Classification Search

USPC ..... 399/38, 42, 46, 48, 50, 66
See application file for complete search history.

(56) References Cited

U.S. PATENT DOCUMENTS 8,180,238 B2 * 5/2012 Inukai ..... G03G 15/1675 399/154
9,268,282 B2 * 2/2016 Saito ..... G03G 15/553
9,395,642 B2 * 7/2016 Matsuura ..... G03G 15/0266

FOREIGN PATENT DOCUMENTS

JP 2007-232881 9/2007

* cited by examiner

*Primary Examiner* — Hoan Tran
(74) *Attorney, Agent, or Firm* — Wenderoth, Lind & Ponack, L.L.P.

(57) ABSTRACT

Provided is an image forming apparatus, wherein when it is predicted that a surface potential of at least one of a plurality of photosensitive drums becomes less than the predetermined potential, whenever transfer of toner images corresponding to a predetermined number of sheets is completed by a plurality of transfer rollers, continuous print is interrupted for a predetermined time, a voltage with a polarity equal to a polarity of toner is applied to the plurality of transfer rollers by a power supply or the application of the voltage to the plurality of transfer rollers is stopped during the predetermined time.

5 Claims, 5 Drawing Sheets

IMAGE FORMING APPARATUS

CROSS-REFERENCE TO RELATED APPLICATION

This application is based upon and claims the benefit of priority from Japanese Patent Application No. 2015-130190 filed on Jun. 29, 2015, the entire contents of which are incorporated herein by reference.

BACKGROUND

The technology of the present disclosure relates to an image forming apparatus.

In an electrophotographic image forming apparatus, a surface of a photosensitive drum is uniformly charged to a predetermined polarity, light corresponding to predetermined image data is irradiated to the charged surface of the photosensitive drum so as to form an electrostatic latent image, the electrostatic latent image is developed to form a toner image, and the toner image is transferred to a member to be transferred (a paper, an intermediate transfer belt and the like) by a transfer roller. The aforementioned transfer roller is connected to a high voltage power supply. Furthermore, by a transfer electric field formed between the transfer roller and the surface of the photosensitive drum, the toner image of the surface of the photosensitive drum is transferred to the member to be transferred.

As the charging method of the aforementioned photosensitive drum, there is proposed a contact charging method for allowing a charging member to abut the photosensitive drum and charging the surface of the photosensitive drum to a predetermined polarity. According to the contact charging method, it is advantageous that it is possible to suppress an ozone generation amount as compared with a conventional non-contact type corona charging method (a so called scorotron method).

In a charging device employing such a contact charging method, a charging roller method using a conductive roller in the charging member is proposed. According to this method, it is possible to uniformly charge the surface of the photosensitive drum.

SUMMARY

An image forming apparatus according to one aspect of the present disclosure includes a plurality of photosensitive drums, a plurality of transfer rollers, one power supply, a prediction unit, and a control unit. The plurality of photosensitive drums are configured to be able to carry toner images of each color. The plurality of transfer rollers are respectively provided to face the photosensitive drums and transfer the toner images carried on surfaces of the photosensitive drums to a member to be transferred. The one power supply applies a voltage to each transfer roller. The prediction unit predicts whether a surface potential of at least one of the plurality of photosensitive drums becomes less than a predetermined potential during continuous print in which printing is continuously performed on a plurality of sheets. When the prediction unit predicts that the surface potential of at least one of the plurality of photosensitive drums becomes less than the predetermined potential, whenever transfer of toner images corresponding to a predetermined number is completed by the plurality of transfer rollers in the execution of the continuous print, the control unit interrupts the continuous print for a predetermined time, and applies a voltage with a polarity equal to a polarity of toner to the plurality of transfer rollers by the power supply or stops the application of the voltage to the plurality of transfer rollers during the predetermined time.

DETAILED DESCRIPTION

Hereinafter, embodiments of the present disclosure will be described in detail on the basis of the drawings. It is noted that the technology of the present disclosure is not limited to the following embodiments.

Embodiment 1

Figure 1:
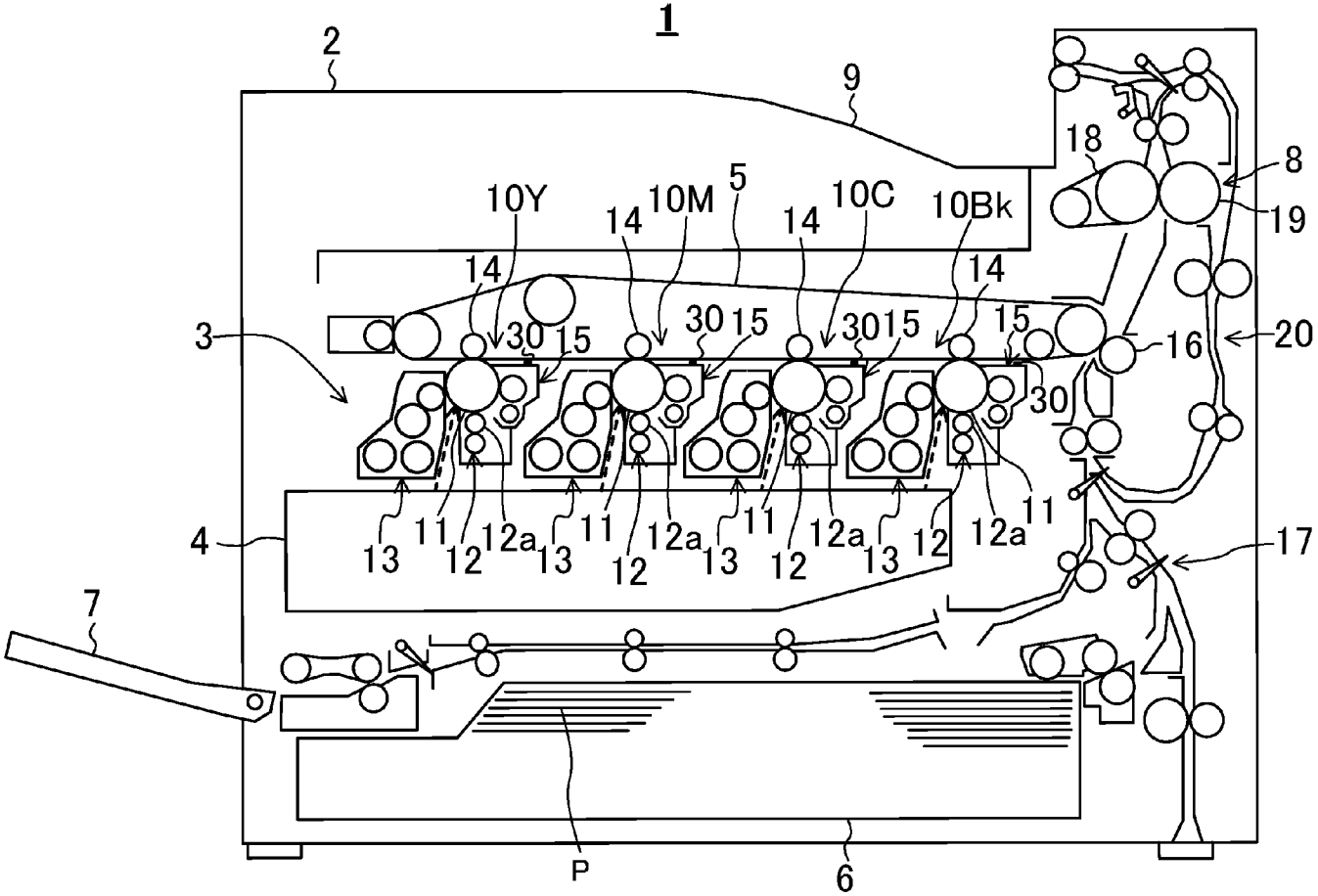
FIG. 1 is a schematic configuration diagram illustrating an image forming apparatus in an embodiment.

FIG. 1 illustrates a schematic configuration diagram of an image forming apparatus 1 according to an example of an embodiment. The image forming apparatus 1 is a tandem type color printer and includes an image forming unit 3 in a box-like casing 2. The image forming unit 3 transfers an image to a sheet P and forms the image on the sheet P on the basis of image data transmitted from an external device such as a computer subjected to network connection and the like. Below the image forming unit 3, an exposure device (an exposure unit 4) is arranged to irradiate laser light, and above the image forming unit 3, a transfer belt (a member to be transferred) 5 is arranged. Below the exposure device 4, a sheet storage unit 6 is arranged to store the sheet P, and at a lateral side of the sheet storage unit 6, a manual sheet feeding unit 7 is arranged. At a lateral upper part of the transfer belt 5, a fixing unit 8 is arranged to perform a fixing process on the image transferred to and formed on the sheet P. A reference numeral 9 indicates a sheet discharge unit arranged at an upper portion of the casing 2 to discharge the sheet P subjected to the fixing process in the fixing unit 8.

The image forming unit 3 includes four image forming units 10Y, 10M, 10C, and 10Bk that respectively form yellow, magenta, cyan, and black toner images. The four image forming units 10Y, 10M, 10C, and 10Bk are arranged in a row along the transfer belt 5. Each of the image forming units 10Y, 10M, 10C, and 10Bk has a photosensitive drum 11. Directly under each photosensitive drum 11, a charging device 12 is arranged, and at one side of each photosensitive drum 11, a developing device (a developing unit) 13 is arranged. Directly above each photosensitive drum 11, a primary transfer roller 14 is arranged, and at the other side of each photosensitive drum 11, a cleaning unit 15 is arranged to clean the peripheral surface of the photosensitive drum 11. At an upper end portion of the cleaning unit 15, an electricity removing device 30 is arranged.

Each photosensitive drum 11 is charged by the charging device 12 to a polarity equal to a charged polarity (a positive polarity in the present embodiment) of toner. The charging device 12 employs a charging roller method (in the present embodiment, for example, a DC charging roller method) as a charging method. That is, the charging device 12 has a charging roller 12*a* in which its peripheral surface is driven to rotate while abutting the peripheral surface of each photosensitive drum 11 and applies charge (positive charge in the present embodiment) to the photosensitive drum 11. Onto the peripheral surface of each photosensitive drum 11 charged by the charging device 12, laser light corresponding to each color based on the image data inputted from the computer and the like is irradiated from the exposure device 4. Accordingly, an electrostatic latent image is formed on the peripheral surface of the photosensitive drum 11. A developer is supplied to the electrostatic latent images from the developing device 13, so that a toner image of yellow, magenta, cyan, or black is formed on the peripheral surface of each photosensitive drum 11. These toner images are respectively superposed on and transferred to the transfer belt 5 by a voltage with a polarity opposite to the charged polarity of toner applied to the primary transfer roller 14.

A reference numeral 16 indicates a secondary transfer roller arranged below the fixing unit 8 in the state of abutting the transfer belt 5, and the sheet P conveyed along a sheet conveyance path 17 from the sheet storage unit 6 or the manual sheet feeding unit 7 is interposed between the secondary transfer roller 16 and the transfer belt 5 and the toner images on the transfer belt 5 are transferred to the sheet P by a transfer voltage applied to the secondary transfer roller 16.

The fixing unit 8 includes a heating roller 18 and a pressure roller 19. In the fixing unit 8, the sheet P is interposed by the heating roller 18 and the pressure roller 19 so as to be pressed and heated, so that the toner images, which have been transferred to the sheet P, are fixed to the sheet P. The sheet P subjected to the fixing process is discharged to the sheet discharge unit 9. A reference numeral indicates an inversion conveyance path for inverting the sheet P discharged from the fixing unit 8 at the time of duplex printing.

The electricity removing device 30 is provided in the vicinity of a downstream side of the primary transfer roller 14 on the peripheral surface of each photosensitive drum 11. Furthermore, the electricity removing device 30 performs post-transfer electricity removal that irradiates electricity removing light to the peripheral surface of the photosensitive drum 11 after primary transfer. In this way, the generation of a transfer memory, which is generated on the photosensitive drum 11, is suppressed.

Figure 2:
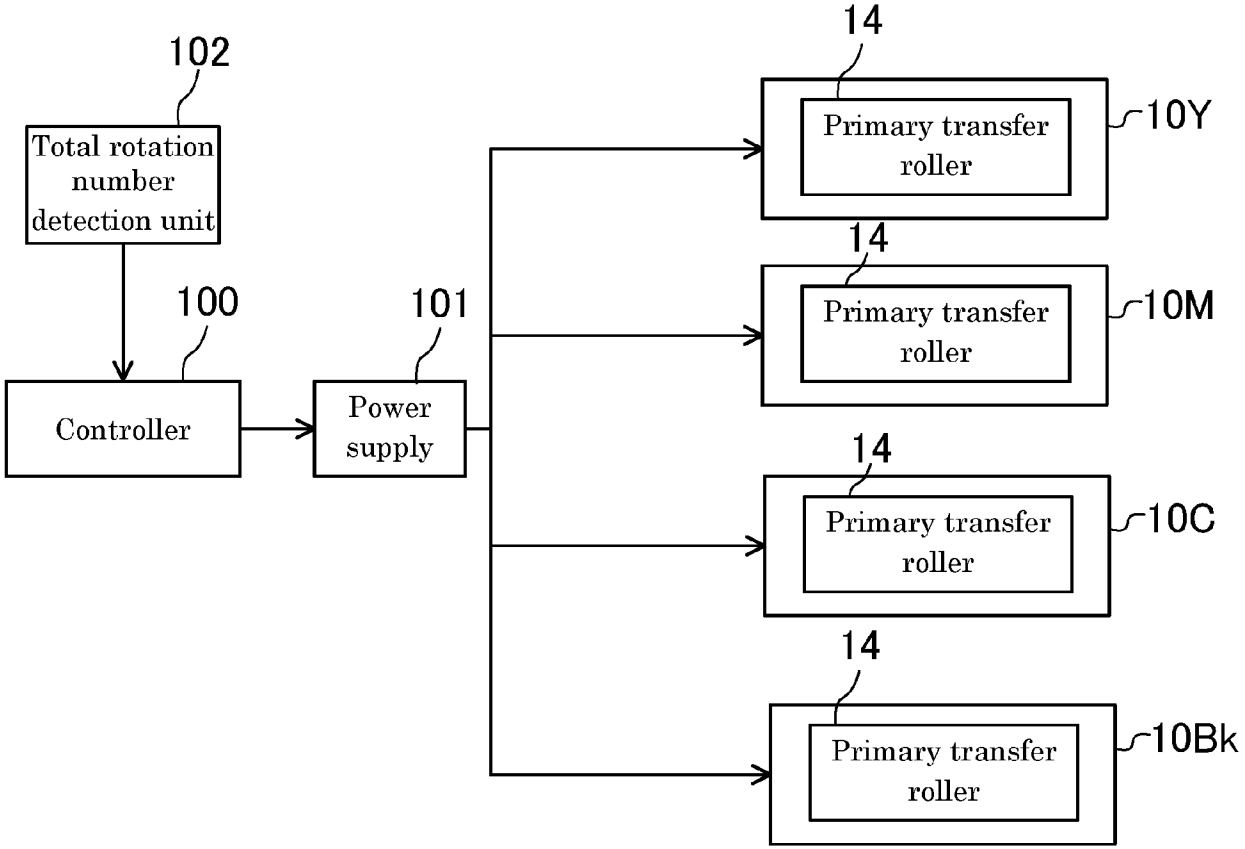
FIG. 2 is a block diagram illustrating a part of a control system of an image forming apparatus.

As illustrated in FIG. 2, the four transfer rollers 14 provided for the image forming units 10Y, 10M, 10C, and 10Bk are connected to one common power supply 101. The power supply 101 receives a command from a controller 100 and selectively switches a forward voltage (a voltage with a polarity opposite to the charged polarity of the toner) and a backward voltage (a voltage with a polarity equal to the charged polarity of the toner), thereby applying the forward voltage or the backward voltage to the four transfer rollers 14.

The controller 100 serving as a control unit includes a micro computer having a CPU, a ROM, and a RAM. The controller 100, for example, controls a print operation of the image forming apparatus 1 based on signals from an operating unit (not illustrated) operable by a user. The operating unit, for example, is configured by a touch type liquid crystal panel operable when it is touched by a finger of a user.

The controller 100 is electrically connected to the power supply 101 and a total rotation number detection unit 102. The total rotation number detection unit 102 detects the number of rotations of the photosensitive drum 11 of each of the image forming units 10Y, 10M, 10C, and 10Bk, thereby detecting the total numbers of rotations Ry, Rm, Rc, and Rbk from a time point of starting to use the photosensitive drums 11 to a present time point and transmitting information on the detected total numbers of rotations Ry, Rm, Rc, and Rbk to the controller 100. The total rotation number detection unit 102, for example, includes a rotation number detection sensor embedded in a driving motor of each photosensitive drum 11.

The controller 100 is configured to be able to perform continuous print control for continuously performing printing on a plurality of sheets. When performing the continuous print control, the controller 100 predicts in advance whether the surface potential of at least one of the four photosensitive drums 11 becomes less than a predetermined potential during continuous print based on the detection information detected by the total rotation number detection unit 102, and selectively switches and performs first print control and second print control, which will be described later, on the basis of this prediction. As described above, the controller 100 also serves as a prediction unit.

Herein, the aforementioned predetermined potential is a potential (for example, 400 V) lower than a target charging potential (for example, 500 V) of each photosensitive drum 11 by the charging device 12. The predetermined potential is a maximum value of a potential range in which a transfer memory is generated at the time of continuous print and is decided in advance by an experiment and the like.

Figure 3:
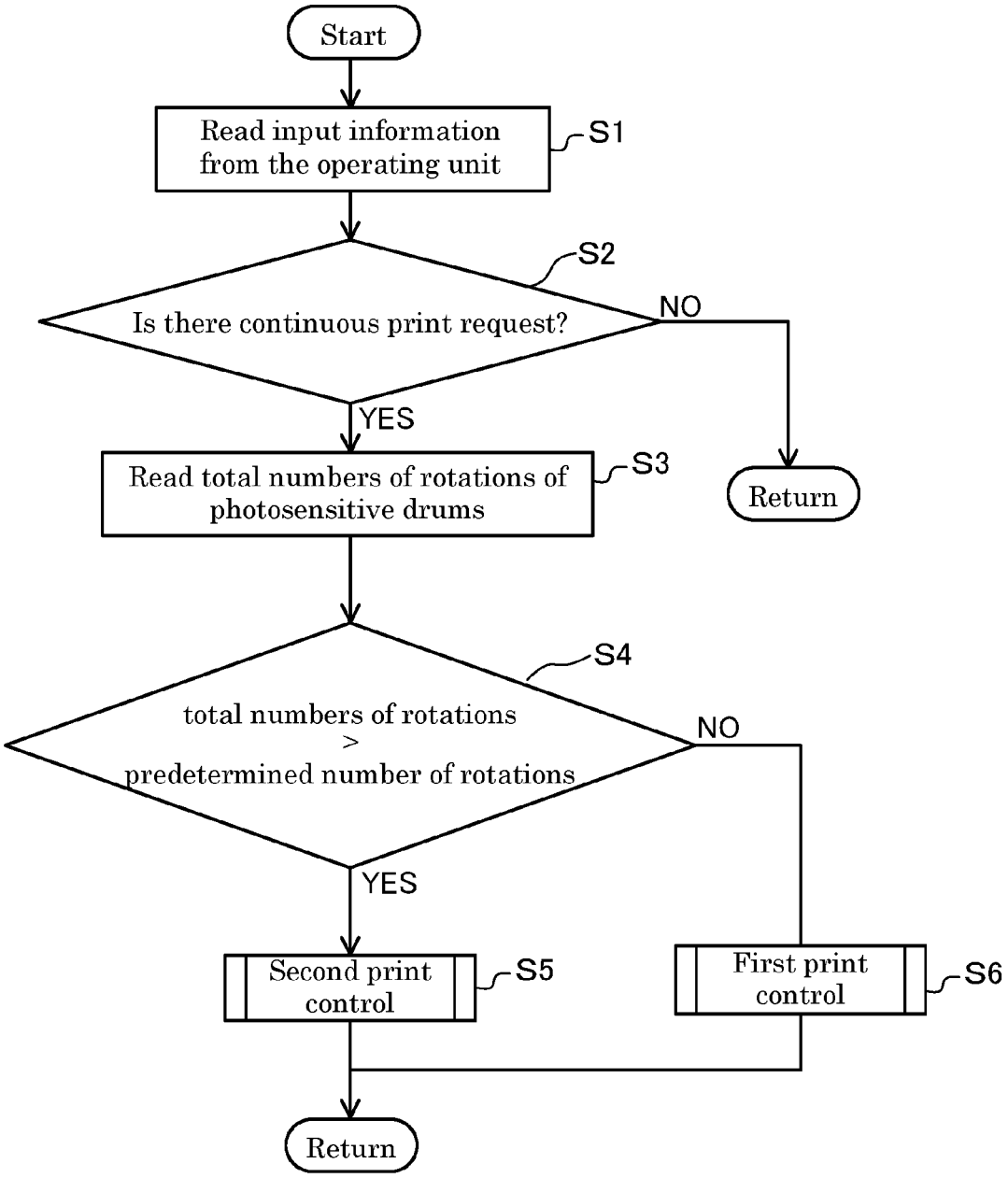
FIG. 3 is a flowchart illustrating details of continuous print control performed by a controller.

With reference to the flowchart of FIG. 3, details of the continuous print control in the controller 100 will be described.

In an initial step S1, a user inputs information from the operating unit is read.

In step S2, based on the information read in step S1, it is determined whether there is a continuous print request of continuously performing printing on a plurality of sheets. When this determination is NO, the procedure is returned, but when this determination is YES, the procedure proceeds to step S3.

In step S3, the total rotation number detection unit 102 reads the total numbers of rotations Ry, Rm, Rc, and Rbk of the photosensitive drums 11.

In step S4, it is determined whether at least one of the total numbers Ry, Rm, Rc, and Rbk of rotations read in step S3 exceeds a predetermined number of rotations. When this determination is NO, it is predicted that the surface potential of each photosensitive drum 11 does not become less than a predetermined potential during the execution of the continuous print and the procedure proceeds to step S6. On the other hand, when the determination is YES, it is predicted that the surface potential of the photosensitive drum 11, the total number of rotations of which is equal to or more than the predetermined number of rotations, becomes less than the predetermined potential during the execution of the continuous print and the procedure proceeds to step S5.

In step S5, second print control is performed and then the procedure is returned.

In step S6 which is performed when the determination of step S4 is NO, first print control is performed and then the procedure is returned.

Figure 4:
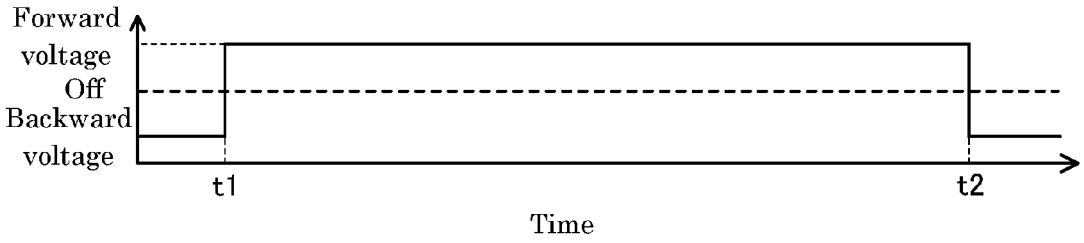
FIG. 4 is a time chart illustrating an example of first print control performed by a controller.

FIG. 4 is a time chart illustrating an example of the first print control. In this first print control, from the start time point (a time t1) to an end time point (a time t2) of the continuous print, a forward voltage (with a polarity opposite to the charged polarity of toner and a voltage with a negative polarity in the present embodiment) is applied to each primary transfer roller 14 by the power supply 101. After the continuous print is ended, a backward voltage (with a polarity equal to the charged polarity of the toner and a voltage with a positive polarity in the present embodiment) is applied to each primary transfer roller 14 by the power supply 101.

Figure 5:
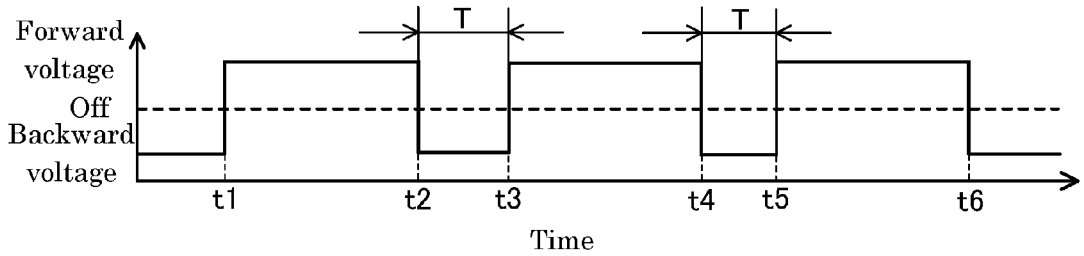
FIG. 5 is a time chart illustrating an example of second print control performed by a controller.

FIG. 5 is a time chart illustrating an example of the second print control. In the second print control, whenever transfer of a predetermined number of (in the present embodiment, for example, three) toner images is completed by the plurality of transfer rollers 14, continuous print is interrupted for a predetermined time T and a backward voltage is applied to the plurality of transfer rollers 14 by the power supply 101 during the predetermined time T. During the predetermined time, the controller 100 stops the conveyance of a sheet at a conveyance upstream side from the secondary transfer roller 16 or reduces the conveyance speed of a sheet to be lower than a sheet conveyance speed in the first print control, thereby keeping a subsequent sheet waiting at an upstream side from the secondary transfer roller 16. The predetermined time is equal to a time required when the photosensitive drum 11 rotates once. It is noted that the rotation speeds of the photosensitive drums 11 are equal to one another.

As described above, in the aforementioned embodiment, when the controller 100 predicts in advance whether the surface potential of at least one of the plurality of photosensitive drums 11 becomes less than the predetermined potential during continuous print, whenever toner transfer corresponding to a predetermined number is completed by the four transfer rollers 14, the backward voltage (with a polarity equal to the charged polarity of the toner and a positive polarity in the present embodiment) is applied to each transfer roller 14. In this way, a transfer current is suppressed from flowing into each photosensitive drum 11 from each primary transfer roller 14, and a voltage with a positive polarity can be applied to the surface of each photosensitive drum 11 through each transfer roller 14. In this way, the surface potential of the photosensitive drum 11 is recovered near a target charging potential, so that it is possible to maximally avoid the generation of the transfer memory.

Furthermore, in the aforementioned embodiment, a prediction process is performed focused on a correlation between the easiness of the generation of the transfer memory (that is, the reduction of the surface potential of each photosensitive drum 11) and the degree of abrasion of the surfaces of the photosensitive drums 11. That is, in the aforementioned embodiment, the total numbers of rotations Ry, Rm, Rc, and Rbk of the photosensitive drums 11, which are values associated with the degree of abrasion of the surface of the photosensitive drums 11, are detected by the total rotation number detection unit 102 and whether the surface potential of each photosensitive drum 11 becomes less than the predetermined potential during the continuous print is predicted by the controller 100 based on the total numbers of rotations Ry, Rm, Rc, and Rbk detected by the total rotation number detection unit 102.

According to this, it is possible to perform the aforementioned prediction by using the rotation number detection sensor of the photosensitive drum 11 provided to the existing image forming apparatus 1 without newly providing a potential sensor and the like for detecting the surface potential of the photosensitive drum 11. Thus, it is possible to reduce the cost of the entire image forming apparatus 1.

Moreover, in the aforementioned embodiment, when it is predicted by the controller 100 that the surface potential of the photosensitive drum 11 becomes less than the predetermined potential, a time (the aforementioned predetermined time) for which the continuous print is interrupted has been set to be equal to a time required when the each photosensitive drum 11 rotates once.

According to this, while the continuous print is being interrupted, it is possible to apply a potential with a positive polarity by allowing the transfer roller 14 to make contact with an entire peripheral surface of each photosensitive drum 11. Thus, it is possible to prevent the transfer memory from remaining on a part of the peripheral surface of the photosensitive drum 11.

Other Embodiments

In the aforementioned embodiment, based on the total numbers of rotations of each photosensitive drum 11, the controller 100 predicts whether the surface potential of each photosensitive drum 11 becomes less than the predetermined potential; however, the technology of the present disclosure is not limited thereto. That is, for example, the surface potential of each photosensitive drum 11 may also be directly detected by a potential sensor and the like. In this case, when it has been detected that at least one of the surface potentials of the photosensitive drums 11 detected by the potential sensor has become less than the predetermined potential during the execution of the continuous print, after the toner transfer being performed by the plurality of transfer rollers 14 has been completed at the time of the detection, the controller 100 interrupts the continuous print for the predetermined time T, applies the backward voltage (the voltage with the polarity equal to the charged polarity of the toner) to the plurality of transfer rollers 14 by the power supply 101 during the predetermined time T, and restarts the continuous print after the predetermined time passes. Accordingly, the potential sensor and the controller 100 serve as a detection unit.

In this way, it is possible to achieve operations and effects similar to the aforementioned embodiment. In addition, since the surface potential of the photosensitive drum 11 is directly detected by the potential sensor, it is possible to more accurately perform the determination regarding on whether each photosensitive drum 11 has become less than the predetermined potential.

Figure 6:
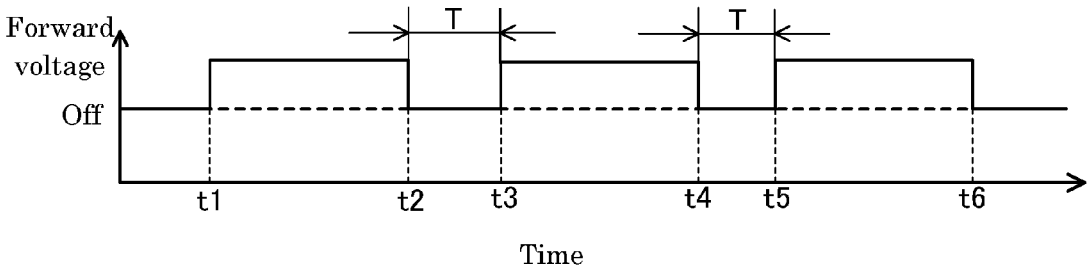
FIG. 6 is a diagram corresponding to FIG. 5, which illustrates an embodiment 2.

Furthermore, in the aforementioned embodiment, the backward voltage (the voltage with the polarity equal to the charged polarity of the toner) is applied to each transfer roller 14 by the controller 100 during the predetermined time T; however, the technology of the present disclosure is not limited thereto and for example, as illustrated in FIG. 6, the application of the voltage to each transfer roller 14 may also be stopped.

Furthermore, in the aforementioned embodiment, the predetermined time T has been set to be equal to the time required when each photosensitive drum 11 rotates once; however, the technology of the present disclosure is not limited thereto and the predetermined time T may also be a time longer than the time. Furthermore, the predetermined time T may also be changed in response to values detected by the total rotation number detection unit 102. In this case, for example, it is sufficient if the largest one of the total numbers of rotations Ry, Rm, Rc, and Rbk of the photosensitive drums 11 detected by the total rotation number detection unit 102 is selected and the predetermined time is made longer as the selected number of rotation is larger.

In the aforementioned embodiment, the example, in which the transfer scheme of the image forming apparatus 1 is an intermediate transfer scheme, has been described; however, the technology of the present disclosure is not limited thereto and the transfer scheme may also be a direct transfer scheme. In this case, the aforementioned sheet corresponds to a member to be transferred.

What is claimed is:

1. An image forming apparatus comprising:

a plurality of photosensitive drums that carry toner images of each color respectively;

a plurality of transfer rollers respectively provided to face each of the photosensitive drums and transferring the toner images carried on surfaces of the photosensitive drums to a member to be transferred;

one power supply that applies a voltage to each of the transfer rollers;

a prediction unit that predicts whether a surface potential of at least one of the plurality of photosensitive drums becomes less than a predetermined potential during continuous print in which printing is continuously performed on a plurality of sheets; and a control unit that, when the prediction unit predicts that the surface potential of at least one of the plurality of photosensitive drums becomes less than the predetermined potential, whenever transfer of toner images corresponding to a predetermined number of sheets is completed by the plurality of transfer rollers in execution of the continuous print, interrupts the continuous print for a predetermined time, applies a voltage with a polarity equal to a polarity of toner to the plurality of transfer rollers by the power supply or stops application of the voltage to the plurality of transfer rollers during the predetermined time, and restarts the continuous print after the predetermined time passes.

2. The image forming apparatus of claim 1 further comprising:

a total rotation number detection unit that detects total numbers of rotations from a time point of starting to use the photosensitive drums to a present time point, wherein the prediction unit performs the prediction based on the total numbers of rotations of the photosensitive drums, which are detected by the total rotation number detection unit.

3. The image forming apparatus of claim 1, wherein rotation speeds of the photosensitive drums are equal to one another, and the predetermined time is equal to or more than a time required when each photosensitive drum rotates once.

4. The image forming apparatus of claim 1 further comprising:

a charging unit that charges a surface of each photosensitive drum to a predetermined polarity;

an exposure unit that forms an electrostatic latent image by irradiating light to the surface of each photosensitive drum charged to the predetermined polarity by the charging unit; and a developing unit that forms the toner images by attaching toner of each color to the electrostatic latent image formed on the surface of each photosensitive drum, wherein the charging unit has a charging roller that is driven to rotate while abutting the surface of each photosensitive drum and charges each photosensitive drum to the predetermined polarity.

5. An image forming apparatus comprising:

a plurality of photosensitive drums that carry toner images of each color respectively;

a plurality of transfer rollers respectively provided to face the photosensitive drums and transferring the toner images carried on surfaces of the photosensitive drums to a member to be transferred;

one power supply that applies a voltage to each of the transfer rollers;

a detection unit that detects whether a surface potential of at least one of the plurality of photosensitive drums becomes less than a predetermined potential during continuous print in which printing is continuously performed on a plurality of sheets; and a control unit that, when the detection unit has detected that the surface potential of at least one of the plurality of photosensitive drums has become less than the predetermined potential during execution of the continuous print, after toner transfer being performed by the plurality of transfer rollers has been completed at the time of the detection, interrupts the continuous print for a predetermined time, applies a voltage with a polarity equal to a polarity of toner to the plurality of transfer rollers by the power supply or stops application of the voltage to the plurality of transfer rollers during the predetermined time, and restarts the continuous print after the predetermined time passes.

* * * * *